US010519796B2

(12) United States Patent
Grover

(10) Patent No.: US 10,519,796 B2
(45) Date of Patent: Dec. 31, 2019

(54) VARIABLE AREA TURBINE VANE ROW ASSEMBLY

(71) Applicants: United Technologies Corporation, Hartford, CT (US); Eric A. Grover, Tolland, CT (US)

(72) Inventor: Eric A. Grover, Tolland, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 184 days.

(21) Appl. No.: 15/022,227

(22) PCT Filed: Sep. 16, 2014

(86) PCT No.: PCT/US2014/055743
§ 371 (c)(1),
(2) Date: Mar. 16, 2016

(87) PCT Pub. No.: WO2015/084452
PCT Pub. Date: Jun. 11, 2015

(65) Prior Publication Data

US 2016/0230584 A1 Aug. 11, 2016

Related U.S. Application Data

(60) Provisional application No. 61/878,458, filed on Sep. 16, 2013.

(51) Int. Cl.
*F01D 17/16* (2006.01)
*F01D 9/04* (2006.01)

(52) U.S. Cl.
CPC ..... *F01D 17/162* (2013.01); *F01D 9/041* (2013.01); *F05D 2220/32* (2013.01);
(Continued)

(58) Field of Classification Search
CPC ..... F01D 9/04; F01D 9/041; F01D 17/162; F05D 2240/123; F05D 2240/124;
(Continued)

(56) References Cited

U.S. PATENT DOCUMENTS 2,065,974 A * 12/1936 Marguerre ..... F01K 3/006 236/91 F
3,632,224 A * 1/1972 Wright ..... F01D 17/162 415/151

(Continued)

FOREIGN PATENT DOCUMENTS

DE 3413304 A1 10/1985

OTHER PUBLICATIONS

Extended European Search Report dated Mar. 27, 2017 in related EP Patent Application No. 14868181.0, 8 pages.

(Continued)

*Primary Examiner* — Dwayne J White
*Assistant Examiner* — Danielle M. Christensen
(74) *Attorney, Agent, or Firm* — Cantor Colburn LLP

(57) ABSTRACT

The present disclosure relates generally to a variable area turbine vane row assembly. In an embodiment, the variable area turbine vane row assembly includes rotatable vanes that are circumferentially biased and/or axially biased with respect to adjacent fixed vanes. In another embodiment, the variable area turbine vane row assembly includes multiple rotatable vanes positioned between adjacent fixed vanes, which may optionally be circumferentially biased and/or axially biased with respect to each other as well as to the adjacent fixed vanes.

11 Claims, 6 Drawing Sheets

(52) U.S. Cl.
CPC .. *F05D 2240/123* (2013.01); *F05D 2240/124* (2013.01); *F05D 2250/73* (2013.01)

(58) Field of Classification Search
CPC ..... F05D 2250/37; F05D 2250/73; F05D 2260/961; F05D 2270/051; F05D 2270/07; F05D 2270/306; F05D 2270/3061; F04D 29/563
See application file for complete search history.

(56) References Cited

U.S. PATENT DOCUMENTS

| | | | | |
|---|---|---|---|---|
| 4,874,289 | A * | 10/1989 | Smith, Jr. ..... | F04D 29/563 415/150 |
| 8,105,019 | B2 * | 1/2012 | McCaffrey ..... | F02C 9/22 415/160 |
| 2002/0057966 | A1 | 5/2002 | Fiala et al. | |
| 2004/0265124 | A1 | 12/2004 | Liu et al. | |
| 2007/0119150 | A1 * | 5/2007 | Wood ..... | F01D 17/162 60/226.1 |
| 2010/0124487 | A1 | 5/2010 | Guemmer | |
| 2010/0247293 | A1 | 9/2010 | McCaffrey et al. | |
| 2011/0110763 | A1 | 5/2011 | Tecza et al. | |

OTHER PUBLICATIONS

International Search Report for Application No. PCT/US2014/055743.
Written Opinion for Application No. PCT/US2014/055743.

* cited by examiner

VARIABLE AREA TURBINE VANE ROW ASSEMBLY

CROSS-REFERENCE TO RELATED APPLICATIONS

The present application claims the benefit of and incorporates by reference herein the disclosure of U.S. Ser. No. 61/878,458 filed Sep. 16, 2013.

GOVERNMENT LICENSE RIGHTS

This invention was made with government support under Contract No. N00014-09-D-0821-0006 awarded by the United States Navy. The government has certain rights in the invention.

TECHNICAL FIELD OF THE DISCLOSURE

The present disclosure is generally related to rotating assemblies for turbomachinery and, more specifically, to a variable area turbine vane row assembly.

BACKGROUND OF THE DISCLOSURE

In gas turbine engines, energy is added to the air through the processes of compression and combustion, while energy is extracted by means of a turbine. In a turbofan engine, compression is accomplished sequentially through a fan and thereafter through a low-pressure compressor and high-pressure compressor, with the fan and low-pressure compressor being driven by a low-pressure turbine and the high-pressure compressor being driven by a high-pressure turbine through concentric shaft connections. Combustion occurs between the high-pressure compressor and the high-pressure turbine. Since the energy available to the turbines far exceeds that required to maintain the compression process, the excess energy is exhausted as high velocity gases through one or more nozzles at the rear of the engine to produce thrust by the reaction principle.

Typically, turbines within an engine are comprised of fixed geometries which are designed to provide balanced performance across a wide engine operating range. By introducing to a high-pressure and/or low-pressure turbine the ability to vary the turbine inlet flow area, the turbine can be adjusted to achieve optimal engine performance at multiple engine operating points. One metric of performance for the engine may be maximum achievable thrust. The level of engine thrust may be increased by allowing the high-pressure turbine to accept more flow for a given combustor exit temperature by increasing the high-pressure turbine inlet area, as governed by the flow area of the first row of high-pressure turbine vanes. Another metric of performance may be minimized fuel consumption. It is characteristic of some of these variable cycle engines that both the high and low pressure turbines contain mechanisms to allow for variable turbine inlet flow areas.

Various designs for providing a variable turbine inlet flow area using rotatable vanes have been proposed, but improvements are still needed in the art.

SUMMARY OF THE DISCLOSURE

In one embodiment, a variable area turbine vane row assembly is disclosed, comprising: a first fixed vane; a second fixed vane proximate the first fixed vane; and a first rotatable vane asymmetrically positioned between the first and second fixed vanes.

In a further embodiment of the above, the first rotatable vane is circumferentially biased toward the first fixed vane.

In a further embodiment of any of the above, the first rotatable vane is circumferentially biased toward a suction side of the first fixed vane.

In a further embodiment of any of the above, the first rotatable vane is circumferentially biased toward a pressure side of the first fixed vane.

In a further embodiment of any of the above, the first rotatable vane is axially biased in an aft design direction with respect to the first and second fixed vanes.

In a further embodiment of any of the above, the first rotatable vane is axially biased in a forward design direction with respect to the first and second fixed vanes.

In a further embodiment of any of the above, the first rotatable vane is both circumferentially biased toward the first fixed vane and axially biased in a forward design direction with respect to the first and second fixed vanes.

In a further embodiment of any of the above, the first rotatable vane is both circumferentially biased toward the first fixed vane and axially biased in an aft design direction with respect to the first and second fixed vanes.

In another embodiment, a variable area turbine vane row assembly is disclosed, comprising: a first fixed vane; a second fixed vane proximate the first fixed vane; and a plurality of rotatable vanes positioned between the first and second fixed vanes; wherein no other fixed vanes are positioned between the first and second fixed vanes.

In a further embodiment of the above, the plurality of rotatable vanes comprises three rotatable vanes.

In a further embodiment of any of the above, the plurality of rotatable vanes comprises a first rotatable vane and a second rotatable vane.

In a further embodiment of any of the above, the first rotatable vane is asymmetrically positioned between the first fixed vane and the second rotatable vane.

In a further embodiment of any of the above, the first rotatable vane is circumferentially biased toward the first fixed vane.

In a further embodiment of any of the above, the first rotatable vane is circumferentially biased toward a suction side of the first fixed vane.

In a further embodiment of any of the above, the first rotatable vane is circumferentially biased toward a pressure side of the first fixed vane.

In a further embodiment of any of the above, the first rotatable vane is axially biased in an aft design direction with respect to the first and second fixed vanes.

In a further embodiment of any of the above, the first rotatable vane is axially biased in a forward design direction with respect to the first and second fixed vanes.

In a further embodiment of any of the above, the first rotatable vane is both circumferentially biased toward the first fixed vane and axially biased in a forward design direction with respect to the first and second fixed vanes.

In a further embodiment of any of the above, the first rotatable vane is both circumferentially biased toward the first fixed vane and axially biased in an aft design direction with respect to the first and second fixed vanes.

Other embodiments are also disclosed.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

For the purposes of promoting an understanding of the principles of the invention, reference will now be made to certain embodiments and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 1:
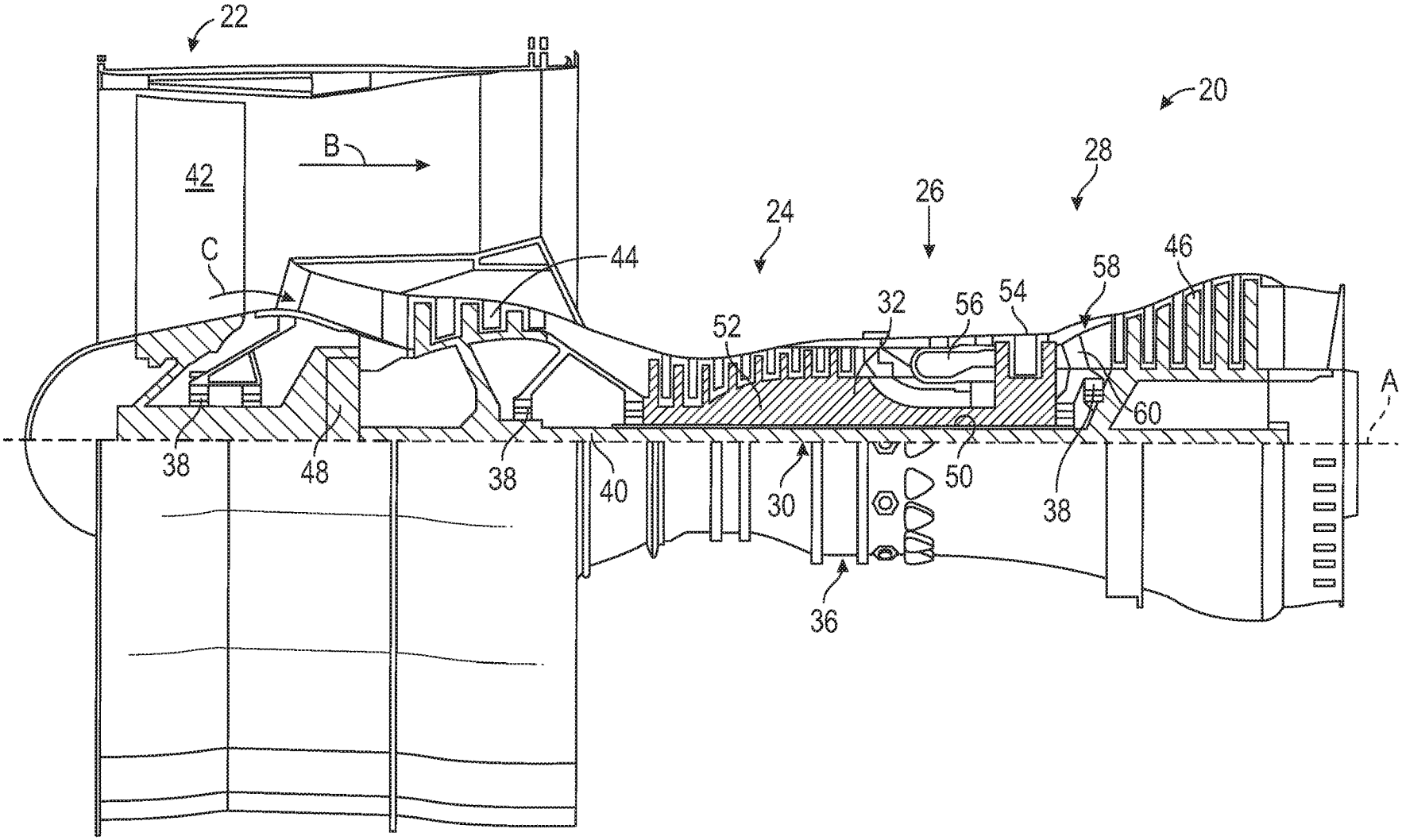
FIG. 1 is a schematic partial cross-sectional diagram of a gas turbine engine according to an embodiment.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second.

Figure 2A:
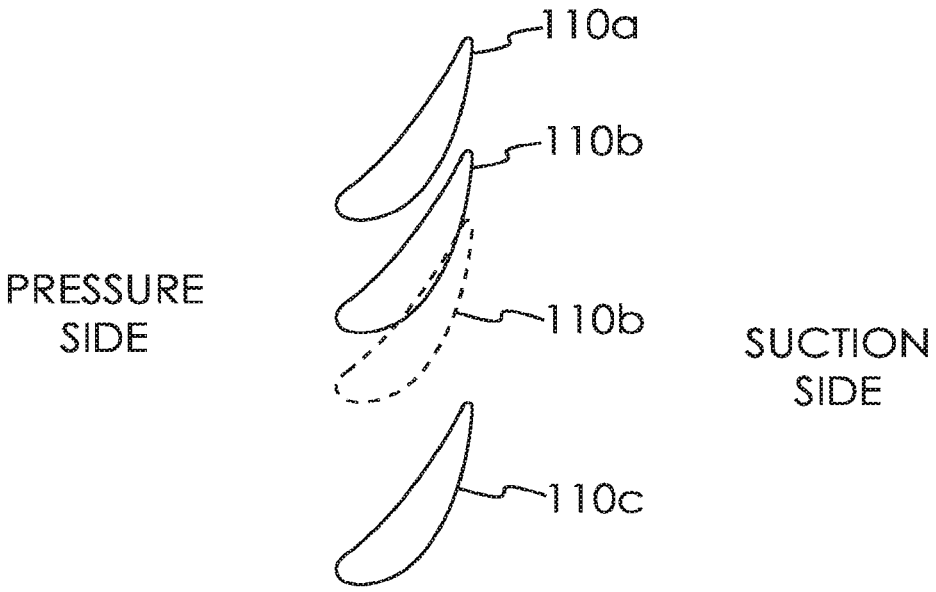
FIGS. 2A-B are schematic diagrams of a variable area turbine vane assembly according to an embodiment.
Figure 2B:
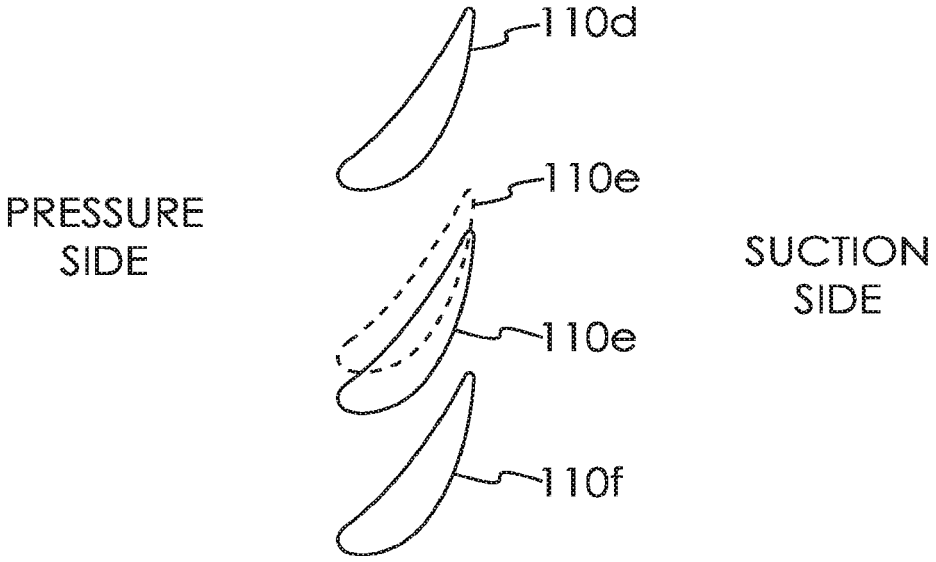

In a gas turbine engine, such as the gas turbine engine 20, the gases from the combustor are directed toward a pair of turbines each including one or more rows of turbine vanes, wherein the vanes in each row are spaced apart circumferentially to direct the flow of combustion gases through the turbine. FIGS. 2A-B each schematically illustrate a vane row segment within a turbine. Vanes 110*a*, 110*b* (in phantom) and 110*c* are shown at the positions where the three vanes in the first illustrated row segment are normally located, while vanes 110*d*, 110*e* (in phantom) and 110*f* are shown at the positions where the three vanes in the second illustrated row segment are normally located. It will be appreciated that each of the vanes 110*a-f* is substantially equidistant from the vanes located on either side of it. The vanes 110*a*, 110*c*, 110*d* and 110*f* are fixed vanes, while vanes 110*b* and 110*e* are rotatable vanes. The provision of rotatable vanes allows for a variable flow area to be provided for the turbine.

Figure 3A:
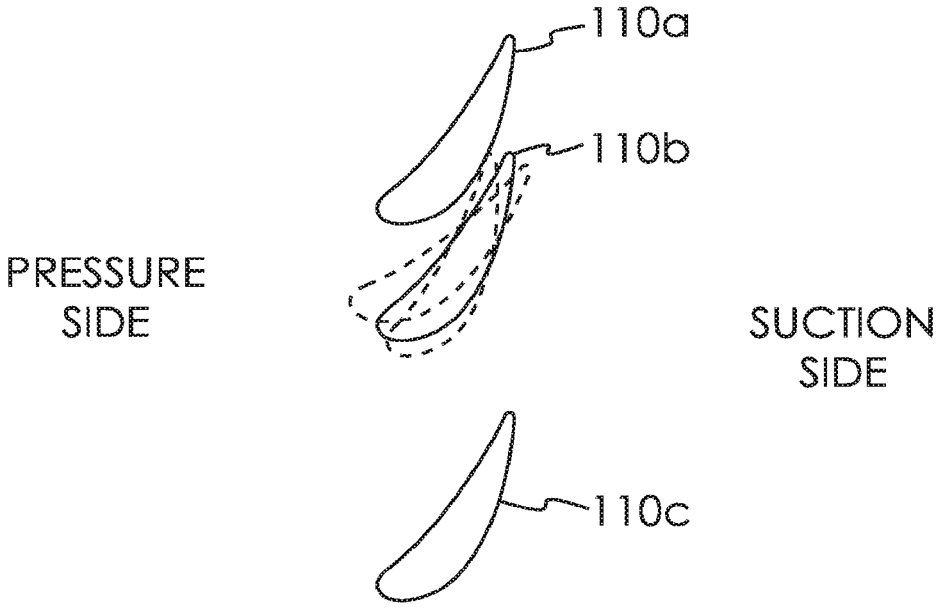
FIGS. 3A-B are schematic diagrams of a variable area turbine vane assembly according to an embodiment.
Figure 3B:
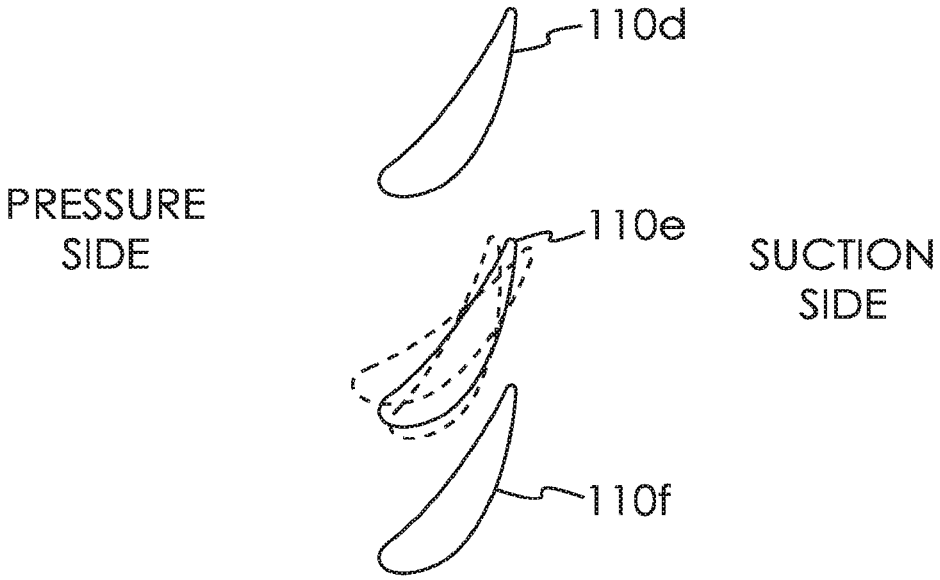

The present disclosure provides in an embodiment for asymmetrical positioning of at least one vane from the vanes located on either side of it in a variable area turbine vane row assembly. For example, FIGS. 2A-B schematically illustrate asymmetrical positioning in the form of circumferential biasing in an embodiment, where the vane 110*b* is shifted toward the suction side of fixed vane 110*a*, and the vane 110*e* is shifted toward the pressure side of fixed vane 110*f*. As schematically illustrated in FIGS. 3A-B, the vanes 110*b* and 110*e* are rotatable, with some positions to which they may be rotated being shown in phantom. Circumferential biasing within the vane row may improve flow conditions as the rotatable vanes are opened and closed, and may also provide more room for the rotating vane to operate.

Figure 4A:
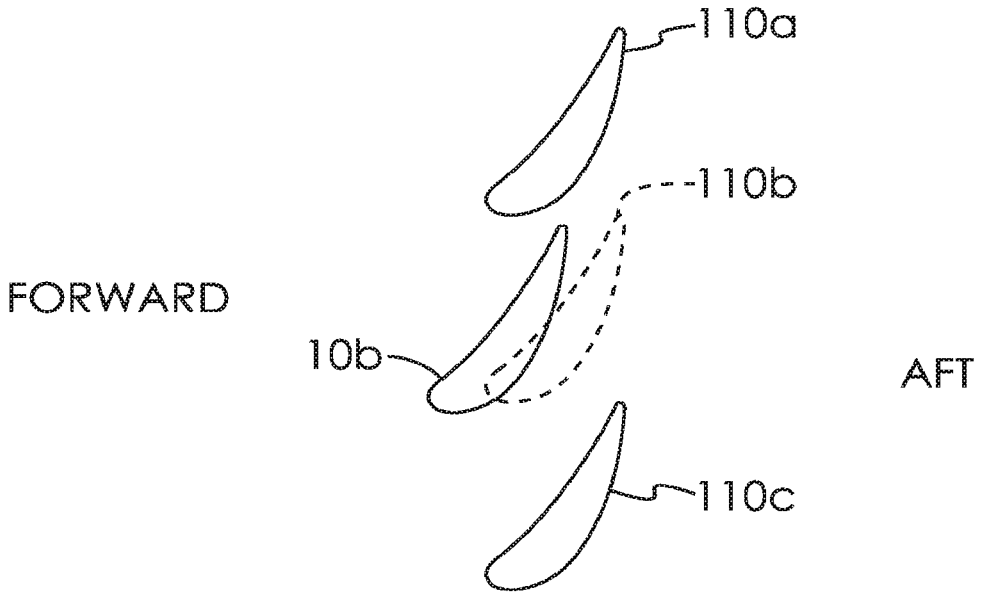
FIGS. 4A-B are schematic diagrams of a variable area turbine vane assembly according to an embodiment.
Figure 4B:
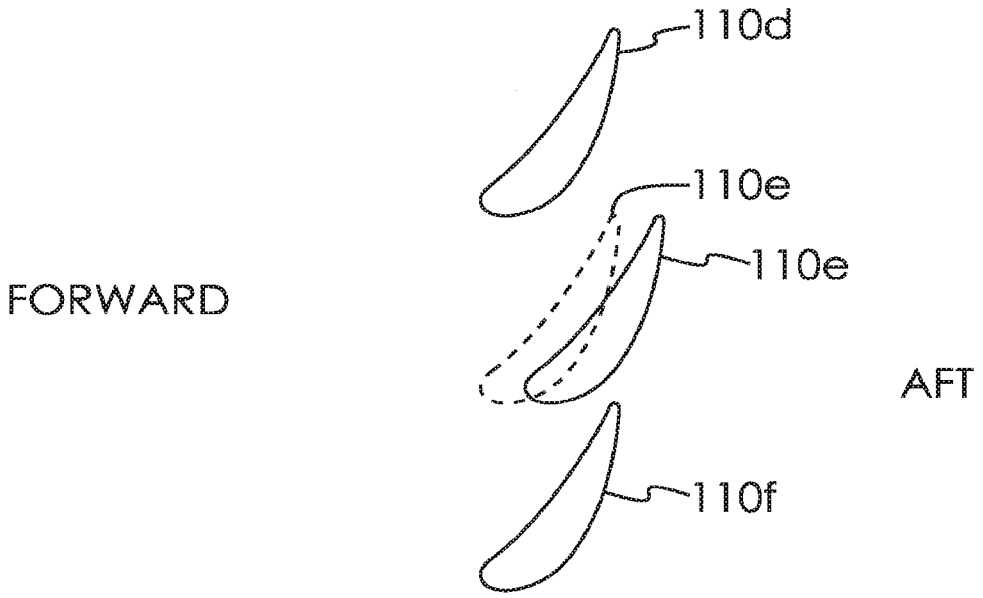
Figure 5A:
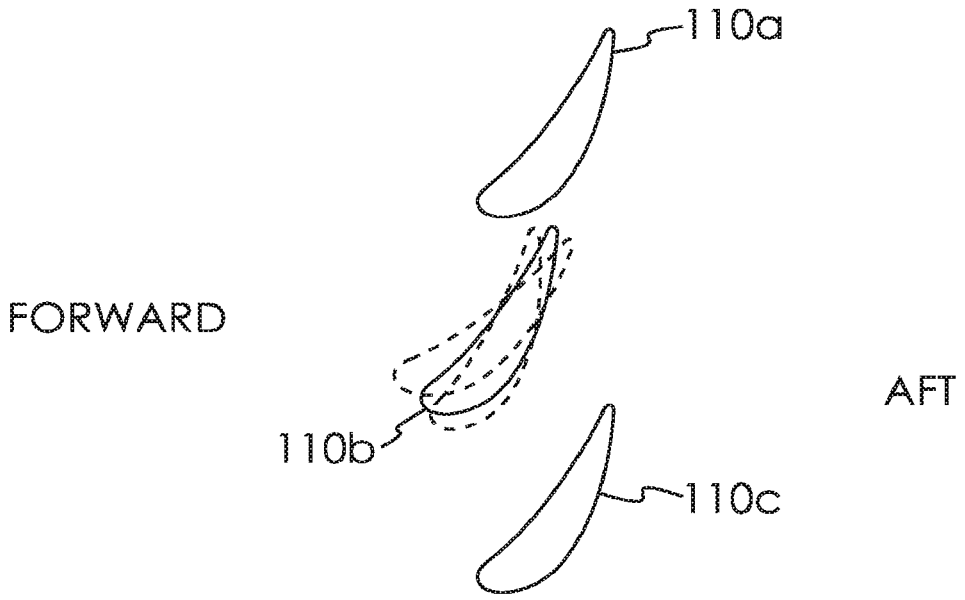
FIGS. 5A-B are schematic diagrams of a variable area turbine vane assembly according to an embodiment.
Figure 5B:
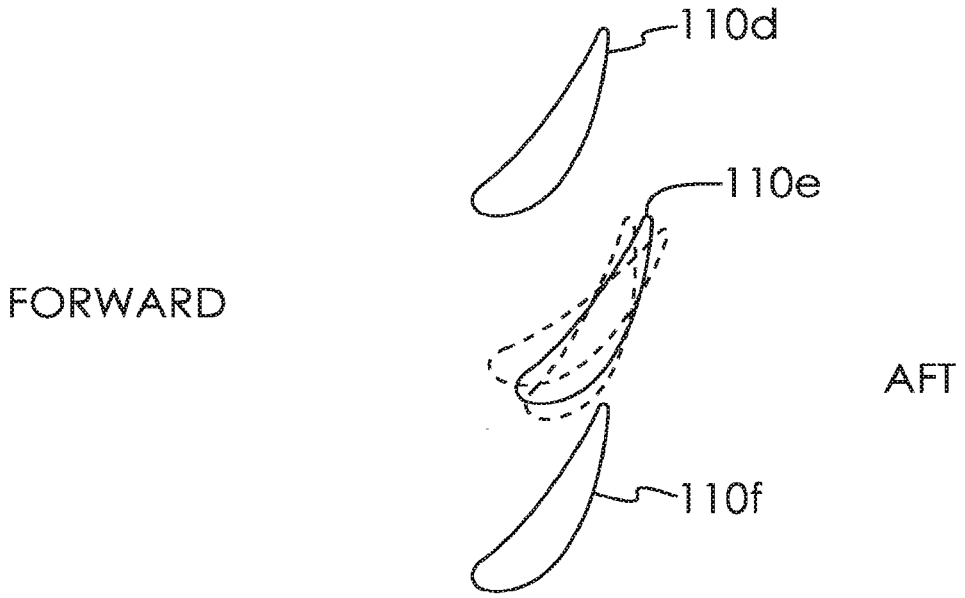

FIGS. 4A-B schematically illustrate asymmetrical positioning in the form of axial biasing in an embodiment, where the vane 110*b* is shifted axially toward a forward design direction from its nominal position (shown in phantom), and the vane 110*e* is shifted axially toward an aft design direction from its nominal position (shown in phantom). As schematically illustrated in FIGS. 5A-B, the vanes 110*b* and 110*e* are rotatable, with some positions to which they may be rotated being shown in phantom. Axial biasing within the vane row may also improve flow conditions as the rotatable vanes are opened and closed, and may additionally provide more room for the rotating vane to operate. Furthermore, any vane may be both circumferentially biased and axially biased.

Figure 6:
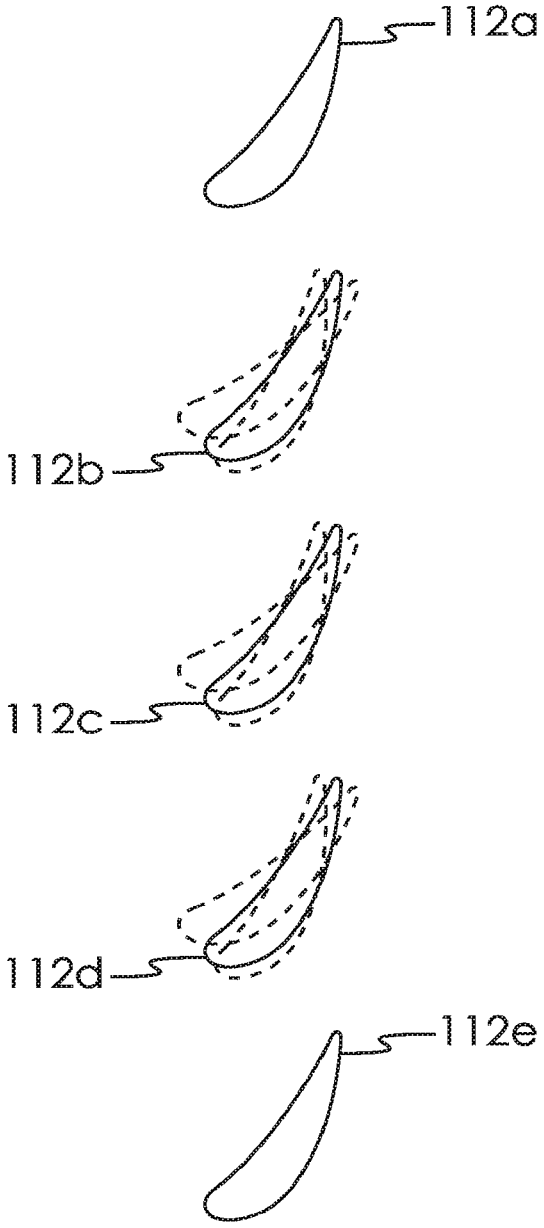
FIG. 6 is a schematic diagram of a variable area turbine vane assembly according to an embodiment.

The present disclosure further encompasses in an embodiment providing a plurality of rotating vanes between a pair of fixed vanes in a vane row, regardless of whether or not the vanes are asymmetrically spaced (i.e., circumferentially biased and/or axially biased with respect to each other as well as to the adjacent fixed vanes) or symmetrically spaced. For example, FIG. 6 schematically illustrates rotatable vanes 112*b-d* positioned between fixed vanes 112*a* and 112*e* on a variable area turbine vane row assembly. This allows for improvement in achieving a desired turbine area change, with less rotation required for the rotating vanes. The presence of fixed vanes next to a rotating vane (as in the embodiments of FIGS. 2-5) restricts the maximum area change that can be achieved in a turbine vane row, as the vane flow passage begins to close down as the rotatable vanes are rotated beyond a predetermined point. Providing multiple rotating vanes adjacent to one another allows for greater area change potential than a configuration with alternating fixed and rotating vanes.

Unlike other solutions where every vane in the vane row rotates or every other vane in the vane row rotates, the presently disclosed system of multiple rotatable vanes between successive fixed vanes balances the structural benefits of having fixed vanes with the aerodynamic benefit of having every vane rotate. The number of fixed vanes and rotating vanes in any vane row assembly will depend upon the particular design constraints of the engine, such as structural needs and vane aerodynamics such as endwall gap loss, flow passage non-uniformity reduction, etc.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed:

1. A variable area turbine vane row assembly, comprising:

a first fixed vane located in a first circumferential vane row organized circumferentially around a rotational axis of a gas turbine engine;

a second fixed vane located in the first circumferential vane row, the second fixed vane being proximate the first fixed vane; and a plurality of rotatable vanes located in the first circumferential vane row, the plurality of rotatable vanes being positioned between the first fixed vane and the second fixed vane;

wherein no other fixed vanes are positioned between the first fixed vane and the second fixed vane within the first circumferential vane row, and wherein the first fixed vane, the second fixed vane, and the plurality of rotatable vanes form a segment of the first circumferential vane row.

2. The variable area turbine vane row assembly of claim 1, wherein the plurality of rotatable vanes comprises three rotatable vanes.

3. The variable area turbine vane row assembly of claim 1, wherein the plurality of rotatable vanes comprises a first rotatable vane and a second rotatable vane.

4. The variable area turbine vane row assembly of claim 3, wherein the first rotatable vane is asymmetrically positioned within the first circumferential van row between the first fixed vane and the second rotatable vane in at least one of a circumferential direction as measured circumferentially around the rotational axis of the gas turbine engine and an axial direction as measured axially along the rotational axis of the gas turbine engine.

5. The variable area turbine vane row assembly of claim 4, wherein the first rotatable vane is circumferentially biased toward the first fixed vane in the circumferential direction as measured circumferentially around the rotational axis of the gas turbine engine within the first circumferential vane row.

6. The variable area turbine vane row assembly of claim 5, wherein the first rotatable vane is circumferentially biased toward a suction side of the first fixed vane in the circumferential direction as measured circumferentially around the rotational axis of the gas turbine engine within the first circumferential vane row.

7. The variable area turbine vane row assembly of claim 5, wherein the first rotatable vane is circumferentially biased toward a pressure side of the first fixed vane in the circumferential direction as measured circumferentially around the rotational axis of the gas turbine engine within the first circumferential vane row.

8. The variable area turbine vane row assembly of claim 3, wherein the first rotatable vane is axially biased in aft design direction with respect to the first fixed vane and the second fixed vane in the axial direction as measured axially along the rotational axis of the gas turbine engine within the first circumferential vane row.

9. The variable area turbine vane row assembly of claim 3, wherein the first rotatable vane is axially biased in a forward design direction with respect to the first fixed vane and the second fixed vane in the axial direction as measured axially along the rotational axis of the gas turbine engine within the first circumferential vane row.

10. The variable area turbine vane row assembly of claim 3, wherein the first rotatable vane is both circumferentially biased toward the first fixed vane in the circumferential direction as measured circumferentially around the rotational axis of the gas turbine engine within the first circumferential vane row and axially biased in a forward design direction with respect to the first fixed vane and the second fixed vane in the axial direction as measured axially along the rotational axis of the gas turbine engine within the first circumferential vane row.

11. The variable area turbine vane row assembly of claim 3, wherein the first rotatable vane is both circumferentially biased toward the first fixed vane in the circumferential direction as measured circumferentially around the rotational axis of the gas turbine engine within the first circumferential vane row and axially biased in an aft design direction with respect to the first fixed vane and the second fixed vane in the axial direction as measured axially along the rotational axis of the gas turbine engine within the first circumferential vane row.

* * * * *